US010271612B2

(12) United States Patent
Zake

(10) Patent No.: US 10,271,612 B2
(45) Date of Patent: Apr. 30, 2019

(54) HIGH HEEL SHOE

(71) Applicant: YZ STUDIO, INC., New York, NY (US)

(72) Inventor: Yamuna Zake, New York, NY (US)

(73) Assignee: YZ Studio, Inc., New York, NY (US)

( * ) Notice: Subject to any disclaimer, the term of this patent is extended or adjusted under 35 U.S.C. 154(b) by 231 days.

(21) Appl. No.: 15/188,276

(22) Filed: Jun. 21, 2016

(65) Prior Publication Data

US 2017/0360147 A1 Dec. 21, 2017

(51) Int. Cl.

| | |
|---|---|
| ***A43B 7/14*** | (2006.01) |
| ***A43B 7/30*** | (2006.01) |
| ***A43B 7/22*** | (2006.01) |
| ***A43B 23/22*** | (2006.01) |

(52) U.S. Cl.

CPC ..... *A43B 7/141* (2013.01); *A43B 7/144* (2013.01); *A43B 7/1485* (2013.01); *A43B 7/22* (2013.01); *A43B 7/30* (2013.01); *A43B 23/222* (2013.01)

(58) Field of Classification Search

CPC ..... A43B 7/14; A43B 7/141; A43B 7/1425; A43B 13/37; A43B 13/143; A43B 21/00; A43B 23/00

USPC ..... 36/108

See application file for complete search history.

(56) References Cited

U.S. PATENT DOCUMENTS 2,772,488 A * 12/1956 Meltzer ..... A43B 13/34 12/147 R
2,912,772 A * 11/1959 Harrison ..... A43B 13/32 36/108
4,003,146 A * 1/1977 Meier ..... A43B 7/14 36/44
4,320,588 A * 3/1982 Sottolana ..... A43B 13/14 36/24.5
4,835,884 A * 6/1989 Bianchini ..... A43B 13/28 36/108
5,722,186 A * 3/1998 Brown ..... A43B 1/0054 36/140
6,408,543 B1 * 6/2002 Erickson ..... A43B 3/26 36/100
6,915,598 B2 * 7/2005 Grisoni ..... A43B 7/141 36/149
7,152,341 B2 * 12/2006 Dean ..... A43B 13/38 36/24.5
7,322,132 B2 * 1/2008 Dananberg ..... A43B 7/14 36/174
7,380,353 B2 * 6/2008 Feller ..... A43B 1/0072 36/108
7,827,707 B2 * 11/2010 Davis ..... A43B 3/26 36/71
8,256,142 B2 * 9/2012 Igdari ..... A43B 7/142 36/102
8,800,170 B1 * 8/2014 Khaitan ..... A43B 17/026 36/28

(Continued)

*Primary Examiner* — Richale L Quinn
*Assistant Examiner* — Anne M Kozak
(74) *Attorney, Agent, or Firm* — Ferdinand IP, LLC

(57) ABSTRACT

A high heel shoe has an insole, an outsole, and a shank embedded between the insole and outsole, the shank comprising a heel portion with a depression to accommodate a user's heel, and a lateral ridge element in front of the heel portion that exerts pressure against the forward movement of a user's heel when worn. The shank further comprises a front portion sloping downward from the lateral ridge along the arch of the insole, which optionally is padded.

15 Claims, 4 Drawing Sheets

(56) References Cited

U.S. PATENT DOCUMENTS 8,813,391 B1* 8/2014 Khaitan ..... A43B 21/00 36/28
2002/0133109 A1* 9/2002 Brown ..... A43B 7/141 602/30
2004/0181976 A1* 9/2004 Copeskey ..... A43B 7/141 36/145
2007/0011918 A1* 1/2007 Snow ..... A43B 13/12 36/108
2009/0007455 A1* 1/2009 Montgomery ..... A43B 7/1445 36/91
2009/0094856 A1* 4/2009 Guerra ..... A43B 7/1425 36/29
2010/0018074 A1* 1/2010 Greene ..... A43B 7/144 36/43
2010/0095551 A1* 4/2010 Gupta ..... A43B 7/144 36/29
2010/0146816 A1* 6/2010 Cappaert ..... A43B 7/141 36/91
2010/0180467 A1* 7/2010 Singleton ..... A43B 7/141 36/88
2010/0269375 A1* 10/2010 Georgoulakis ..... A43B 7/142 36/30 R
2011/0283566 A1* 11/2011 Chou ..... A43B 13/125 36/3 B
2012/0047767 A1* 3/2012 Vattes ..... A43B 7/1445 36/10
2012/0110872 A1* 5/2012 Park ..... A43B 7/1445 36/103
2013/0117948 A1* 5/2013 Dorosin ..... A43B 19/00 12/128 R
2013/0340281 A1* 12/2013 Gossman ..... A43B 13/38 36/43
2015/0027002 A1* 1/2015 Elliott ..... A43B 7/14 36/87
2015/0052777 A1* 2/2015 Jennings ..... A43B 13/18 36/28
2015/0250262 A1* 9/2015 Khaitan ..... A43B 13/40 36/44
2015/0257485 A1* 9/2015 Finkelstein ..... A43B 13/40 36/88
2015/0335099 A1* 11/2015 Dyanov ..... A43B 1/00 36/93
2015/0335102 A1* 11/2015 Jackson ..... A43D 86/00 12/142 R
2016/0021971 A1* 1/2016 Carver ..... A43B 7/14 36/91

* cited by examiner

HIGH HEEL SHOE

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent files or records, but otherwise reserves all copyrights whatsoever.

FIELD OF THE INVENTION

The present invention relates to shoes and, more particularly, to high heel shoes.

BACKGROUND OF THE INVENTION

Conventionally, high heel shoes are constructed such that the user's weight is shifted primarily onto the ball of the foot and the toes. This can cause a large amount of pressure to be placed on a small area of the foot, rather than distributed more evenly throughout the entire foot and heel. As a result, the user's weight is shifted unnaturally forward, which can cause the user to compromise her posture. This change in posture can create pressure in the lower back, tension and curvature in the shoulders, joint pain, muscle tightness and general discomfort. Additionally, excess weight in the toes and ball of the foot can cause foot cramping, arch compression, and pronation, as well as bunions and Morton's neuromas. In addition to causing discomfort to the user, conventional high heels can cause injury, either permanent or temporary, particularly after repeated or prolonged use.

Many shoe companies create high heels with features intended to reduce foot pain, such as lower heels, more padding, and wider areas in the toes and ball of foot. However, while these features may reduce pain, they do not fundamentally impact the posture of the wearer.

The present invention enables the user to retain a more natural posture and weight distribution, thereby reducing, eliminating, or counteracting the typical ill effects of wearing high heels. These and other features of the invention will be fully understood from the following description.

SUMMARY

Accordingly, provided is a high heel shoe having an insole, an outsole, and a shank embedded between the insole and outsole, the shank comprising a heel portion with a depression to accommodate a user's heel, and a lateral ridge element in front of the heel portion that exerts pressure against the forward movement of a user's heel when worn. The shank further comprises a front portion sloping downward from the lateral ridge along the arch of the insole, which optionally is padded.

BRIEF DESCRIPTION OF THE DRAWINGS

Embodiments are illustrated in the figures of the accompanying drawings, which are meant to be exemplary and not limiting, and in which like references are intended to refer to like or corresponding things.

DETAILED DESCRIPTION OF THE PREFERRED EMBODIMENTS

Figure 1:
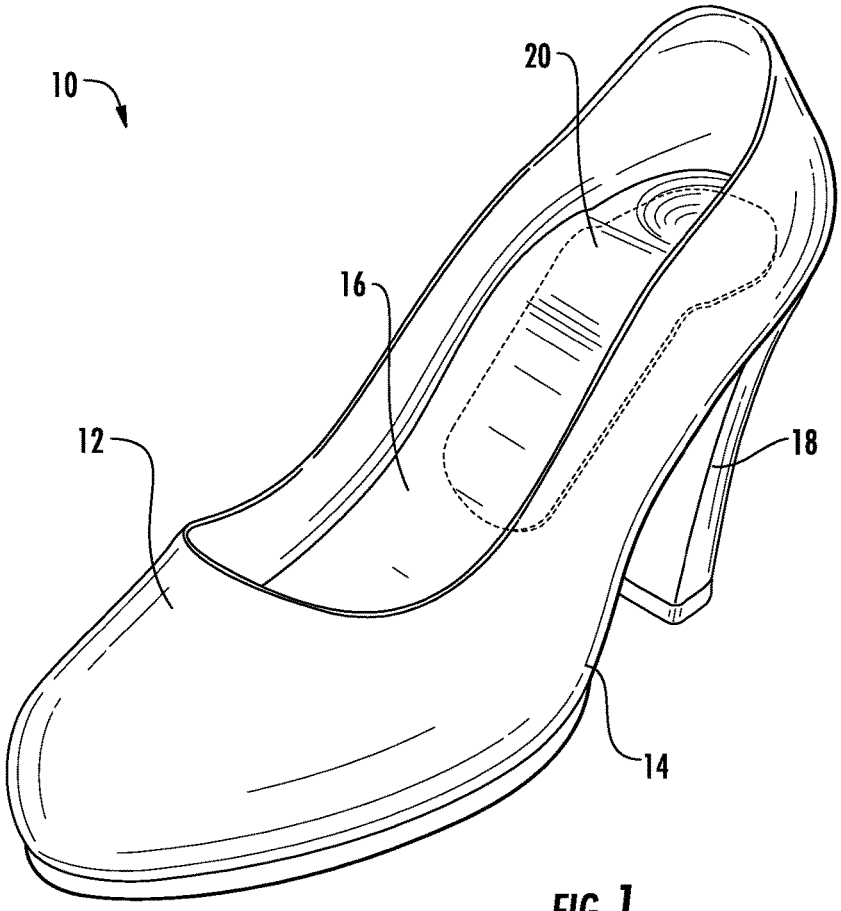
FIG. 1 is a partial cross section perspective view of an embodiment of a high heel shoe according to the present invention.

Referring to the drawings, FIG. 1 shows an embodiment of a high heel shoe 10 having an upper 12, an outsole 14, an insole 16, a high heel 18, and a shank 20, depicted in dotted lines. The shank 20 is embedded between the insole 16 and the outsole 14. The shank 20 extends generally along a longitudinal direction through the shoe 10 from the heel area to approximately the beginning of the ball of the foot.

Figure 2:
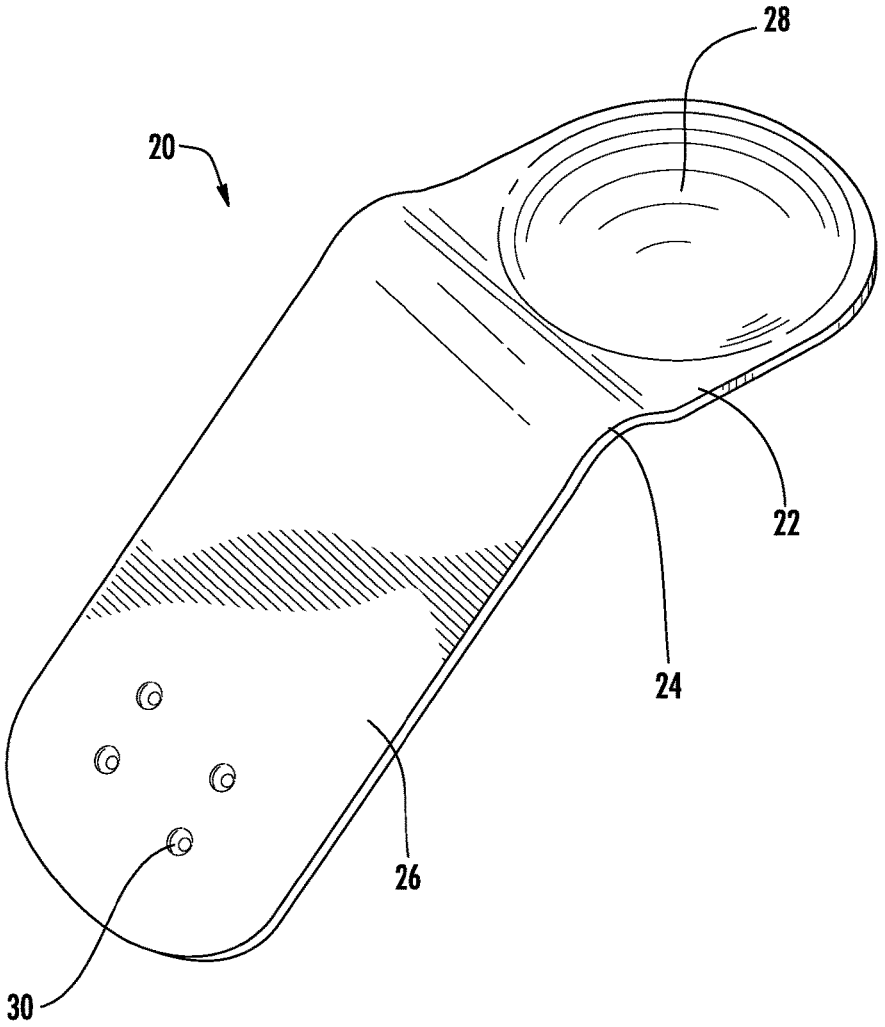
FIG. 2 is a perspective view of the top of a shank component of an embodiment of a high heel shoe according to the present invention.

As shown in FIG. 2, the shank 20 has a heel portion 22 and a front portion 26. Immediately in front of the heel portion 22 is a lateral ridge 24, which extends across the shank 20 in an area that would be just in front of a user's heel. A depression 28 is disposed generally centrally within the heel portion 22 of the shank 20. The depression 28 is configured to receive the user's heel. The depression 28 and the lateral ridge 24 prevent the user's foot from sliding forward in the shoe 10. The front portion 26 of the shank 20 descends from the lateral ridge 24 toward the front of the shoe 10. The embodiment seen in FIG. 2 is shown with an attachment mechanism 30 to secure the shank 20 to the sole structure of the shoe. The attachment shown is a set of holes disposed near the front end of the shank 20 adapted to receive studs or screws. However, in other embodiments the shank can be secured within the shoe by any means known in the art, and at any location along the shank 20.

Figure 3:
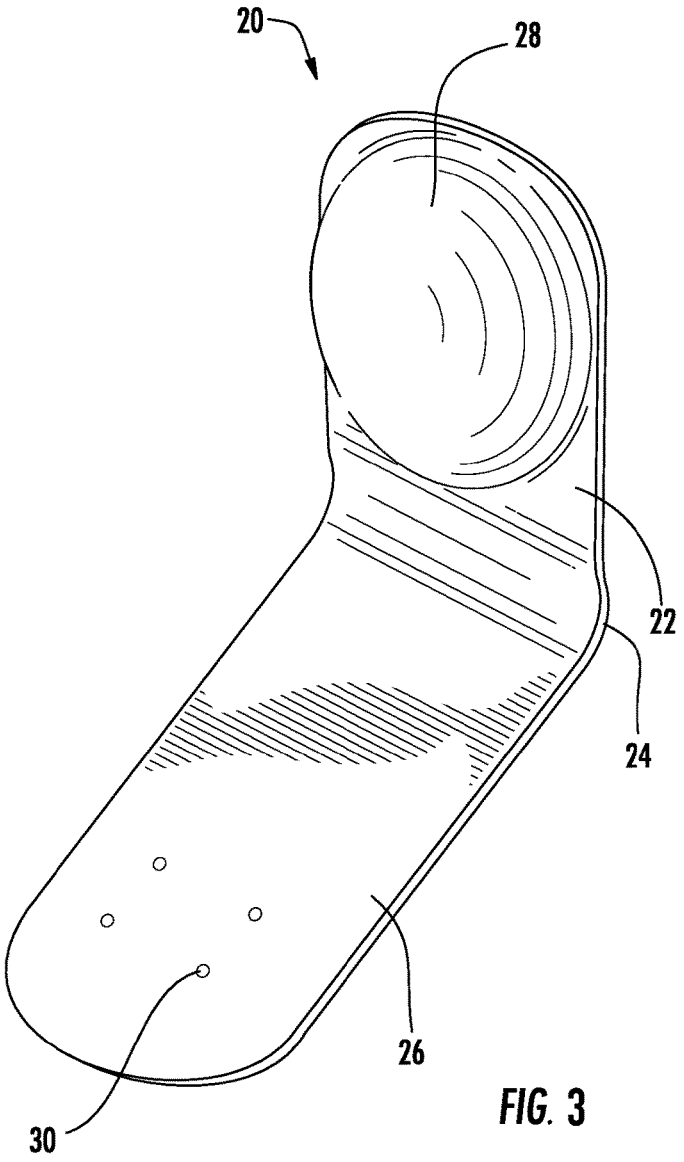
FIG. 3 is a perspective view of the bottom of a shank component of an embodiment of a high heel shoe according to the present invention.

FIG. 3 shows the bottom view of the shank 20 of FIG. 2, from a high heel shoe embodiment according to the present invention. The shank 20 embodiment shown in FIGS. 2 and 3 has a generally uniform width along the entirety of the component. In other embodiments, the shank 20 can vary in width, for example, having a narrowing in part or all of the front portion 26. The shank can be composed of metal, plastic, or any rigid material or combination of materials as known in the art.

Figure 4:
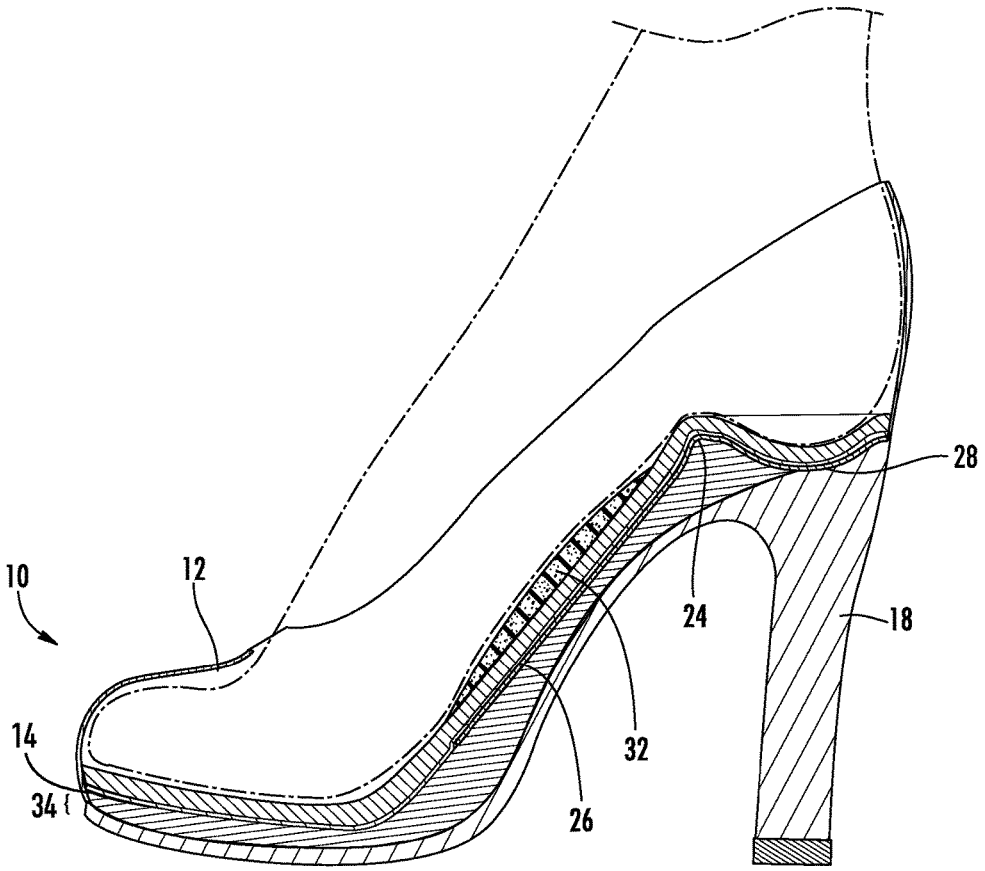
FIG. 4 is a side cross-section of an embodiment of a high heel shoe according to the present invention, with a user's foot shown in dashed lines.

FIG. 4 shows a side cross-section of an embodiment of a high heel shoe according to the present invention. A user's foot is shown in dashed lines to illustrate how the foot sits within the shoe 10. The depression 28 receives the user's heel, and the lateral ridge 24 is located just in front of the user's heel and helps prevent the heel from sliding forward. By holding the user's heel in place, the heel does not drop toward the ball of the foot, compressing the foot and causing cramping. Rather, the foot is permitted to stretch out comfortably within the shoe, without unnecessary stress on the toes and ball of foot.

The depression 28 allows the user to settle more weight into the heel than in a conventional high heel shoe. In a conventional shoe, the user's weight is shifted forward, and the leg extends upward from the shoe at a forward tilted angle. In contrast, by settling the heel into the depression 28, the user can stand comfortably upright, with the ankle and calf extending generally straight up from the shoe, as depicted in FIG. 4. This encourages a more natural posture in the user.

By allowing the user to stand more upright, the high heel of the present invention helps to improve the user's posture, correct lower back problems, and can be worn for extended periods of time without pain and longer term injury to the feet or body. The user can comfortably stand taller and walk straighter than in conventional high heels.

In the embodiment shown in FIG. 4, padding 32 is disposed along the midsole of the shoe, generally where a user's foot arch would fall. The padding 32 allows the user's mid-foot to maintain contact with the shoe and provides support to the user's arch. This allows more complete weight distribution along the entirety of the foot, rather than only at the front foot and heel, which can cause strain and painful pressure to the foot. The padding 32 can be of any appropriate resilient cushioning material, such as foam or memory foam.

It should be understood that the dimensions of the different components may vary. However, it has been found that an embodiment of the high heel shoe functions as described where the components have dimensions as follows, where all measurements are in centimeters: (a) high heel—the height from the center of the ground to the center rear of the high heel at the highest point is approximately 10 cm; (b) heel portion of the shank—the longitudinal length is approximately 4.5 cm, with a lateral width of approximately 4 cm; (c) depression—at the lowest point, the depression is approximately 1 cm below the heel portion of the shank; (d) lateral ridge—at its highest point the lateral ridge is approximately 0.5 cm above the heel portion of the shank and extends across the lateral width of the shank, the width of the lateral ridge is approximately 1.2 cm; (e) front portion of the shank—the longitudinal length extends approximately 9 cm from the lateral ridge, and the lateral width is approximately 4 cm, slightly narrowing to approximately 3.5 cm generally in the center where a user's foot arch would fall.

Also shown in the embodiment of FIG. 4 is a platform 34 which raises the height of the front of the shoe, decreasing the angle of the midsole of the shoe while maintaining heel height. It should be appreciated that other embodiments of the present invention do not contain a platform 34 feature. Moreover, it should be appreciated that although the embodiments shown in the figures are in the form of high heel pump style shoes, all styles and heights of high heel shoes are intended to fall within the scope of the present invention, including, for example, high heel boots and sandals.

It should be understood that the dimensions of the high heel shoe, shank and all components will vary depending on the foot and shoe size of the user, the style of shoe, and the height of the heel. For example, in larger shoe sizes, the length of the shank will be adjusted correspondingly to be longer and/or wider as necessary.

Some embodiments of the present invention comprise additional features such as additional insole cushion layers, or other features as known in the art. The shoe may be made of any suitable materials, such as leather, fabric, plastic, cork, felt, and/or rubber, without departing from the underlying idea or principles of the invention within the scope of the appended claims.

I claim:

1. A shoe comprising:

a sole having an outsole and an insole;

a high heel configured below the outsole, and a shank embedded between the insole and the outsole, the shank extending along a longitudinal direction of the sole, and comprising:

a front portion;

a lateral ridge immediately behind the front portion;

a heel portion, comprising the entire area of the shank behind the lateral ridge;

a depression configured to accommodate a user's heel; wherein the depression is positioned within the area of the heel portion;

an upper affixed to a top portion of the sole; wherein the lateral ridge extends across the entire lateral width of the shank; wherein the upper perimeter of the depression is circular; and wherein the depression occupies less than the entire area of the heel portion of the shank.

2. The shoe of claim 1, further comprising padding disposed along the arch of the insole along at least a portion of the front portion of the shank.

3. The shoe of claim 2 wherein the padding is comprised of memory foam.

4. The shoe of claim 1 wherein the front portion is configured to have a terminal edge corresponding to an area of the sole behind where a user's ball of a foot contacts the insole.

5. The shoe of claim 1 wherein the lateral ridge contacts and exerts pressure against a forward portion of a user's heel when the shoe is worn.

6. The shoe of claim 1, wherein the depression has a depth of between 2 mm and 15 mm.

7. The shoe of claim 1, wherein the depression is located centrally within the heel portion of the shank.

8. The shoe of claim 1, wherein the lateral ridge has a height of between 2 mm and 10 mm above the heel portion of the shank.

9. The shoe of claim 1, further comprising a platform configured below the outsole.

10. The shoe of claim 1, wherein the lateral ridge has a slope that is greater than the slope of the front portion of the shank.

11. A shank for a high heel shoe comprising:

a front portion;

a lateral ridge immediately behind the front portion;

a heel portion, comprising the entire area of the shank behind the lateral ridge;

a depression configured to accommodate a user's heel, wherein the depression is positioned within the area of the heel portion; wherein the lateral ridge extends across the entire lateral width of the shank; wherein the upper perimeter of the depression is circular; and wherein the depression occupies less than the entire area of the heel portion of the shank.

12. The shank of claim 11, wherein the lateral ridge contacts and exerts pressure against a forward portion of a user's heel when the shoe is worn.

13. The shank of claim 11, wherein the depression has a depth of between 2 mm and 15 mm.

14. The shank of claim 11, wherein the depression is located centrally within the heel portion.

15. The shank of claim 11, wherein the lateral ridge has a height of between 2 mm and 10 mm above the heel portion.

* * * * *